United States Patent [19]

Yamashita

[11] Patent Number: 4,834,462

[45] Date of Patent: May 30, 1989

[54] CUTTER FOR IMPACT-TYPE CUTTING MACHINE

[75] Inventor: Hiroyuki Yamashita, Iruma, Japan

[73] Assignee: Waikei Trading Kabushiki Kaisha, Tokyo, Japan

[21] Appl. No.: 184,264

[22] Filed: Apr. 21, 1988

[30] Foreign Application Priority Data

Jan. 26, 1988 [JP] Japan ..... 63-15454

[51] Int. Cl.[4] ..... E01C 23/09

[52] U.S. Cl. ..... 299/39; 125/5; 172/45

[58] Field of Search ..... 299/36, 39, 40, 85; 172/45, 91, 545; 125/5; 56/12.7, 295

[56] References Cited

U.S. PATENT DOCUMENTS

| | | | |
|---|---|---|---|
| 1,773,408 | 8/1930 | Rolfson | 125/5 |
| 2,279,922 | 4/1942 | Kraner | 125/5 |
| 3,695,722 | 10/1972 | Fairweather et al. | 299/39 |
| 4,275,928 | 6/1981 | Jackson | 299/39 |
| 4,725,097 | 2/1988 | Zelenka | 299/39 |

*Primary Examiner*—Thuy M. Bui
*Assistant Examiner*—David J. Bagnell
*Attorney, Agent, or Firm*—Flynn, Thiel, Boutell & Tanis

[57] ABSTRACT

A cutter for an impact-type cutting machine having a cutter shaft which is eccentrically provided on a drive shaft and is adapted to eccentrically rotate around the drive shaft axis. The cutter has an opening therein into which the cutter shaft is inserted with play therebetween. The hole in the cutter extends in the longitudinal direction of said cutter. A central portion of the hole substantially coincides with the center of gravity of the cutter.

6 Claims, 4 Drawing Sheets

CUTTER FOR IMPACT-TYPE CUTTING MACHINE

FIELD OF THE INVENTION

The present invention relates to a cutter for an impact-type cutting machine and, more particularly, to a cutter for an impact-type cutting machine which is capable of increasing its impact force against a surface by means of the action of centrifugal inertia, thereby improving the efficiency with which it cuts the surface.

BACKGROUND OF THE INVENTION

Hitherto, an impact-type cutting machine is known in which a cutter shaft is installed eccentrically with respect to a drive shaft and rotates in conjunction with the drive shaft rotation, and a cutter into which the cutter shaft is inserted with play therebetween so as to rotate eccentrically by means of the action of centrifugal inertia resulting from the rotation of the drive shaft, whereby a surface to be cut is cut by the impact of an external peripheral surface of the cutter.

A floor cutting machine, which is an example of a conventional impact-type cutting machine, is designed to remove projecting portions of a floor surface, deposits, deteriorated floor coating materials, etc., and is arranged such that the rotation of a motor mounted on a base is transmitted to a drive shaft via a belt, and the drive shaft is thereby rotated to cut the floor surface. Two parallel flanges are secured to the drive shaft, and a plurality of cutter shafts are provided between the flanges at equal angular intervals therearound. A plurality of cutters are respectively provided on the cutter shafts in such a manner that each cutter shaft is inserted into a cutter with play (i.e. clearance) therebetween. The cutters are rotated eccentrically due to rotation of the drive shaft and, by virtue of the action of centrifugal inertia, apply the outer peripheral surfaces of the cutters impact against and cut the floor surface.

The hole for the insertion of a cutter shaft, which is provided in each cutter, is conventionally formed with a circular shape and, therefore, has had the following drawbacks:

(1) As the outer peripheral surface of a cutter is brought into contact with the floor surface, the cutter is separated from the cutter shaft and jumps at random around the cutter shaft, so that the impact force necessary for cutting is weakened, and the efficiency with which the floor surface is cut is poor. In addition, in order to increase the impact force with conventional cutters, it is necessary to increase the size of each cutter. Consequently, there is a drawback in that the cutting machine itself becomes larger, and its economic efficiency and operational efficiency are hence deteriorated.

(2) The distance by which each cutter can be offset from its cutter shaft is small when compared with the size of the cutter, and the adaptability of the cutter to uneven portions of the floor surface is poor. Hence, it is difficult to cut relatively large recesses and, if a cutter is brought into contact with a projection, the cutter shaft is pushed upward, resulting in elastic deformation or breakage of the cutter shaft or the cutter.

Accordingly, an object of the present invention is to provide an improved cutter for an impact-type cutting machine which is capable of increasing the impact force imparted by a cutter against a floor surface by means of the force of centrifugal inertia, which improves the efficiency of cutting the floor surface, which is capable of preventing deformation or breakage of the cutter shaft and the cutter, and which can be made more compact and economically advantageous, thereby overcoming the above-described drawbacks.

To attain this object, the present invention provides a cutter for an impact-type cutting machine having a cutter shaft which is eccentrically provided on a drive shaft with respect to the drive shaft axis and is adapted to rotate around the drive shaft in conjunction with the rotation of the drive shaft, and a cutter into which the cutter shaft is inserted with play therebetween, wherein said cutter is provided with a hole for the insertion of the cutter shaft with play or clearance therebetween, which hole extends in the longitudinal direction of the cutter, and wherein a central portion of the hole substantially coincides with the center of gravity of the cutter.

In this arrangement as described above, when the drive shaft is rotated, the cutter shafts are rotated in conjunction with the rotation of the drive shaft, the action of centrifugal inertia is produced in the cutters, the impact force of the cutter against a floor surface becomes large, and the efficiency of cutting the floor surface is improved. At the same time, deformation or breakage of the cutter shaft or cutter is provented or minimized.

BRIEF DESCRIPTION OF THE DRAWINGS

FIGS. 1 to 5 illustrate a first embodiment in accordance with the present invention, in which FIG. 1 is a schematic diagram of an impact-type cutting machine;

FIG. 2 is a schematic diagram illustrating peripheral parts of a drive shaft;

FIG. 3 is an exploded perspective view of the drive shaft and its peripheral parts;

FIG. 4 is a schematic top plan view of a cutter; and

FIG. 5 is a diagram explaining a state of operation of the cutters.

FIGS. 8 and 9 illustrate a second embodiment in accordance with the present invention in which FIG. 8 is a schematic top plan view of the cutter;

FIG. 9 is an enlarged schematic top plan view of the cutter.

FIGS. 10 and 11 are schematic top plan views of a cutter which respectively illustrate other examples of the second embodiment.

DETAILED DESCRIPTION

Figure 1:
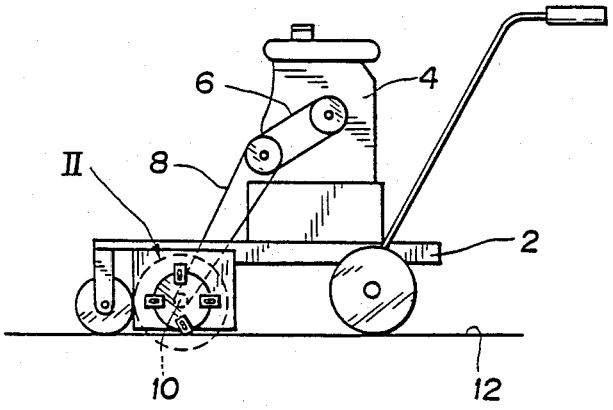
Figure 2:
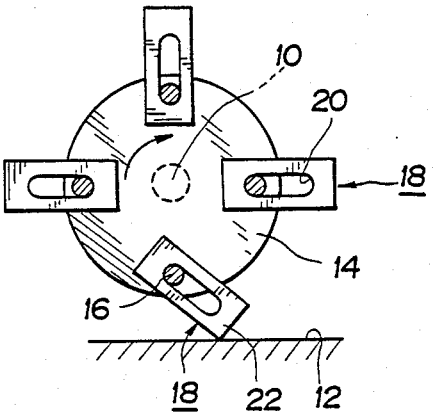

Referring now to the drawings, FIGS. 1 to 5 illustrate a first embodiment of the present invention. As shown in FIGS. 1 and 2, an impact-type cutting machine is arranged such that the rotation of a motor 4 mounted on a base 2 is transmitted to a drive shaft 10 via belts 6 and 8, and this drive shaft 10 is thereby rotated to apply an impact against a floor surface 12 and cut the same.

Figure 3:
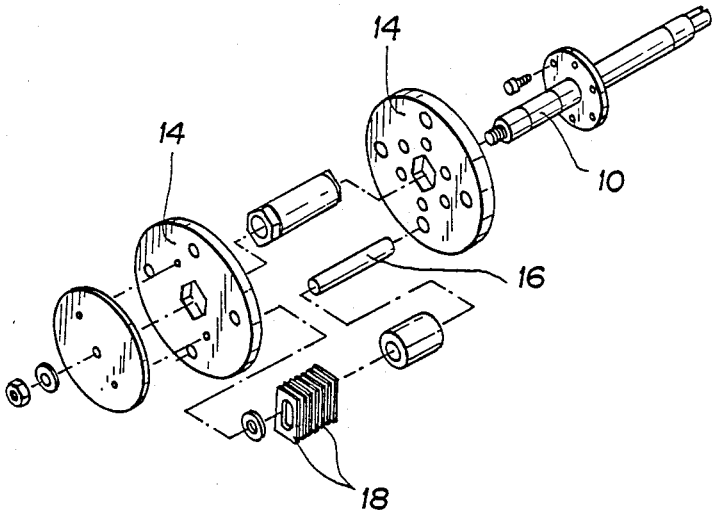
Figure 4:
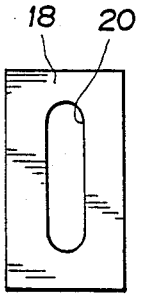

As shown in FIG. 3, two parallel flanges or disks 14 are secured to the horizontal drive shaft 10. A plurality of cutter shafts 16 are installed circumferentially at equal angular intervals between the parallel flanges 14 in radially spaced relation from the axis of shaft 12, and each of the cutter shafts 16 is inserted into a plurality of rectangular planar cutters 18 stacked in series. Thus, each cutter shaft 16 and the cutters 18 thereon are provided eccentrically but parallel with respect to the rotational axis of the drive shaft 10. A longitudinally extending hole, e.g., a slit or slot 20, which functions as a hole into which the cutter shaft 16 is inserted with play or clearance therebetween, is provided in each of the cutters 18. In this embodiment, the cutter plates 18 are substantially of an elongate rectangular configuration. The slit 20 is formed in such a manner that a central portion thereof coincides with the center of gravity of the cutter 18. This center of gravity is located at a central portion of the cutter 18, and the slit 20 is elongated in the direction of the longest side of the cutter.

The shape of the slit 20 is similar to an elongated circle, such as the configuration of a "koban" (an old-fashioned oval-shaped Japanese coin) or an ellipse.

Figure 6:
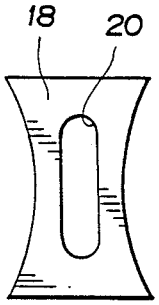
FIGS. 6 and 7 are schematic top plan views of a cutter which respectively illustrate other examples of the first embodiment.
Figure 7:
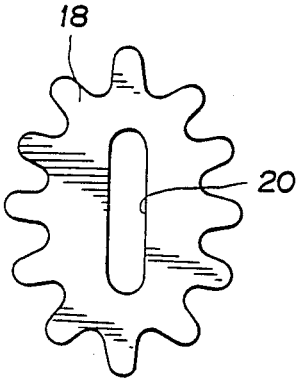

FIGS. 6 and 7 illustrate other examples of this first embodiment, in which the external edges of the cutter 18, which external edges act as impact portions for applying impacts on the floor surface, are varied or deviate from straight edges.

For example, in the variation of FIG. 6, the cutter plate is still generally of an elongate rectangular configuration except that the opposite side edges in the long or elongate direction are provided with a shallow concave configuration.

In the variation of FIG. 7, the cutter plate deviates from rectangular and more closely approximates an elongate elliptical configuration having teeth or projections extending radially outwardly therefrom in substantially uniformly spaced relationship around the external periphery thereof. The external periphery, defined by this series of teeth or projections, hence causes the cutter to have an exterior configuration which more closely resembles the teeth of a gear or sprocket.

In all of the cutter variations described above, specifically as illustrated by FIGS. 4, 6 and 7, the opening 20 is elongated in the elongate direction of the cutter plate, and the opening 20 in effect comprises an elongated slot which is substantially of uniform width (i.e., as defined between parallel side edges), with the ends of the slot being appropriately rounded, such as having concave semi-circular ends so as to more readily accommodate the rounded cutter shaft 16. The width of the slot 20 is close to but slightly exceeds the diameter of the cutter shaft 16 so as to provide substantial sideward confinement, whereas the length of the slot 20 is several times greater than the diameter of the cutter shaft 16.

Figure 5:
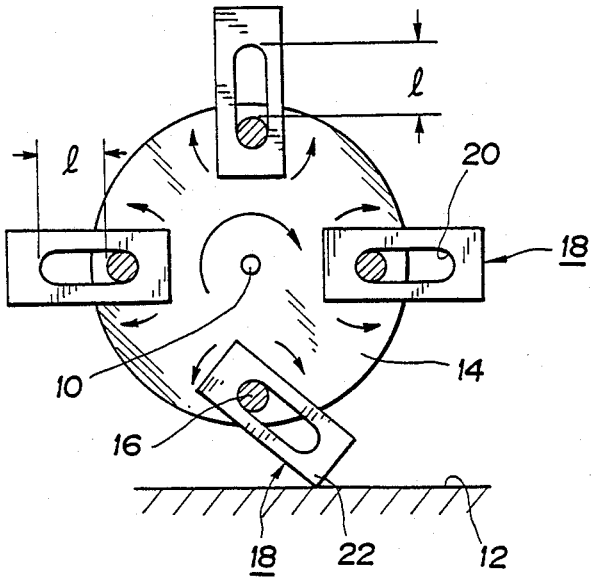

Referring now to FIG. 5, a description will be given of the operation of the impact-type cutting machine.

The slits 20 are made so as to be used as the holes by which the cutters 18 can be inserted over the shafts 16 with play therebetween.

If the flanges 14 secured to the drive shaft 10 are rotated clockwise, as shown in FIGS. 2 and 5, each of the cutters 18 projects outwardly, i.e., radially from the center of the flanges 14, and the cutter 18 applies an impact to the floor surface 12 and cuts the same with a blade 22 formed at the corner portion, i.e., at a diagonal position, of the cutter 18.

This first embodiment has the following advantages:

(1a) Since the slit 20 of the cutter 18 is elongated, and since only a minimum clearance space exists between the inner side edges of the slit 20 and the shaft 16 in the longitudinal direction of the slit 20, at the time when the cutter 18 strikes the floor surface, the cutter 18 rotates eccentrically with the cutter shaft 16 as a center, as shown in FIGS. 2 and 5. Therefore, as compared with a conventional cutter having a conventional enlarged circular hole which permits the cutter to jump at random around the cutter shaft, the improved cutter 18 having the slit 20 is highly constrained and therefore has a large impact force against the floor surface. Hence, a cutter having a high efficiency in cutting the floor surface is provided.

(1b) Furthermore, after striking the floor surface, the cutter cuts the floor surface by being dragged while pressing the floor surface by means of the force of centrifugal inertia. Thus, the action and effect of this cutter are utterly different from the conventional cutter having a conventional circular hole which, after striking, simply rotates without cutting the floor surface. Therefore, the cutting efficiency of this improved cutter is further enhanced.

(1c) In addition, since the arrangement is such that the central portion of the slit 20 substantially coincides with the center of gravity of the cutter, and the slit coincides with the direction of the longest side of the cutter, a blade portion appears at each corner portion of the cutter by the rotation of the cutter, and a blade with a large impact force is created. Accordingly, the operational efficiency improves, and the useful life of the cutter can be prolonged, with the result that this cutter is useful in terms of economic efficiency, and the cutting efficiency can be improved substantially.

(2) Even in the case of a relatively small cutter, since the cutter 18 has the slit 20, the distance l (see FIG. 5) by which the cutter 18 can be offset from the cutter shaft 16 at the time of driving is long, so that the adaptability of the cutter with uneven portions of the floor surface is good, and relatively large recesses can be cut. In addition, the cutter is adapted to cope with projections as well, and it is possible to prevent deformation or breakage of the cutter shaft 16 and the cutters 18 as a result of pushing up the cutter shaft.

(3) In comparison with a conventional cutter having a circular hole, the improved cutter can be made more compact since the impact force of the cutter 18 is large, as described above. Consequently, the overall cutting machine can be made more compact, and it is possible to provide an impact-type cutting machine which excels in economic efficiency and operational features.

Figures 8, 10, 11:
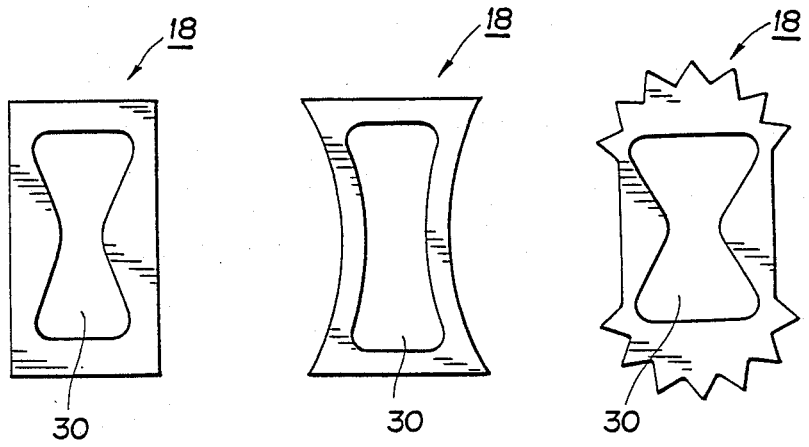
Figure 9:
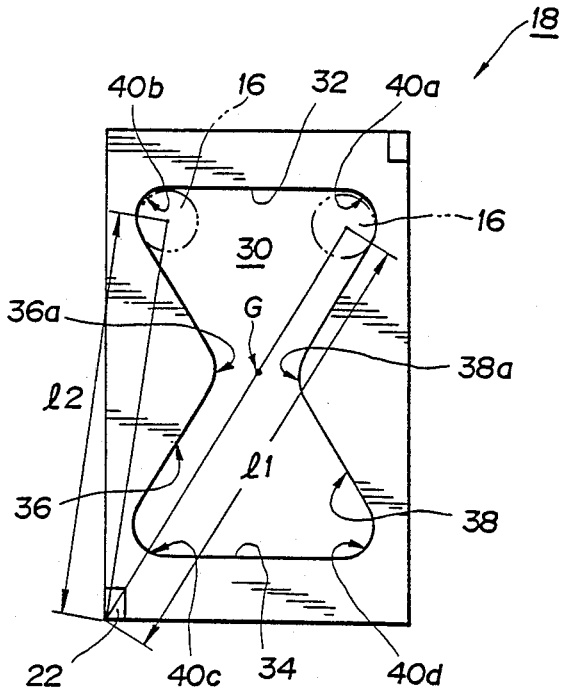

FIGS. 8 and 9 illustrate a second embodiment of the present invention and, in this second embodiment, those portions that perform the same functions as those of the first embodiment are denoted by the same reference numerals and the description thereof has been omitted.

A characteristic feature of this second embodiment is that a hole 30, which extends in the longitudinal direction of the cutter and functions as the hole for insertion of the cutter shaft with play therebetween, is formed in the shape of a hyperboloid of cotyledons, i.e., the shape of an hour-glass.

Namely, as shown in FIGS. 8 and 9, the hourglass-shaped hole 30 is provided in such a manner that the central portion of the hole 30 coincides with the center of gravity G, i.e., the central portion, of the cutter 18. To give a detailed description, the hole 30 has upper and lower edges 32, 34 coinciding with the direction of the short sides of the elongated cutter 18. Hole 30 has rounded inwardly projecting portions 36*a*, 38*a* formed at the middle of the left- and right-hand side edges 36, 38, which side edges extend in the direction of the long side of the cutter 18. Rounded upper and lower corners 40*a*, 40*b*, 40*c*, and 40*d* join the adjacent edges.

The holes 30 are fitted with play around the cutter shaft 16. If the flanges 14 secured to the drive shaft are rotated in a predetermined direction, each of the cutters 18 projects outwardly, i.e., radially from the center of the flange, by virtue of the action of centrifugal inertia, and the cutter strikes and cuts the floor surface with the blade 22 formed at a corner, i.e., a diagonal position, of the cutter 18.

As shown by an alternate long-and-short dash line in FIG. 9, when the cutter shaft 16 is located at the position of the corner 40*a* of the hole 30 and effects striking and cutting at the corner 22, even in the case of a relatively small cutter, the distance by which the cutter 18 can be offset from the cutter shaft 16 by virtue of the hole 30, i.e., the distance l1 from the center of the cutter shaft 16 to the blade 22 for cutting, becomes long (see FIG. 9).

In addition, as shown by an alternate long- and two-short dash line in FIG. 9, when the cutter shaft 16 is located at the corner 40*b* and striking and cutting are effected, the distance by which the cutter 18 can be offset from the cutter shaft 16 by virtue of the hole 30, i.e., the distance from the center of the cutter shaft 16 to the blade 22 for cutting becomes l2 which is smaller than the distance l1. However, the center of gravity G of the cutter 18 is located rearwardly relative to the rotating direction (see FIG. 9).

As a result, the second embodiment displays the following action and effect:

(1) Since the hole 30 is formed in the cutter 18, the marginal space between the inner periphery of the hole 30 and the cutter shaft has the shape of a hyperboloid of cotyledons, i.e., the shape of an hourglass. When the cutter 18 strikes the floor surface, as shown in FIG. 9, the cutter 18 eccentrically rotates about the cutter shaft 16 as a center, and when compared with the conventional cutter with a conventional enlarged circular hole, the cutter with the hole 30 has a high degree of constrainability. Accordingly, a cutter which has a large striking force against the floor surface and a high efficiency of cutting the floor surface is provided.

As shown by the alternate long-and-short dash line in FIG. 9, when the cutter shaft 16 is located at the corner 40*a* and striking and cutting are effected, the distance l1 from the center of the cutter shaft 16 to the blade 22 is long so that the impact force against the floor surface can be large.

In addition, as shown by the alternate long and two-short dash line, when the cutter shaft 16 is located at the corner 40*b* and striking and cutting are effected, the distance l2 from the center of the cutter shaft 16 to the blade 22 is smaller than l1. However, the center of gravity G of the cutter 18 is located rearwardly with respect to the rotating direction. For this reason, when the blade 22 is brought into contact with the floor surface 12 during rotational cutting, the position of the center of gravity G where the action of centrifugal inertia is the greatest is located rearwardly of a segment of a line between the cutter shaft 16 and the striking position on the floor surface relative to the rotating direction. The action of centrifugal inertia functions until the center of gravity G reaches this line segment, and further presses the blade 22 which has come into contact with the floor surface, thereby performing an effective cutting operation.

Furthermore, after striking the floor surface, the cutter cuts the floor surface while pressing the floor surface and being dragged on the same by virtue of the force of centrifugal inertia. The action and effect of this cutter are utterly different from those of the conventional cutter with an enlarged circular hole which, after striking the floor surface, simply rotates without cutting the same. Hence, the cutting efficiency is further improved.

In addition, since the central portion of the hole 30 substantially coincides with the center of gravity of the cutter, and the hole is formed into the configuration of a hyperboloid of cotyledons, or an hourglass shape, a blade portion appears at each corner of the cutter as a result of the rotation of the cutter. Moreover, since a blade with a large impact force appears, the operational efficiency is enhanced, while the useful life of the cutter is prolonged, the cutter is very economically advantageous, and the cutting efficiency can be substantially improved.

Since the distance l1, by which the cutter 18 can be offset by virtue of the hole 30, is made long, and since the center of gravity G of the cutter 18 is located rearwardly relative to the rotating direction and the action of centrifugal inertia can therefore be made to function until the center of gravity G reaches this segment of a line, even in the case of a relatively small cutter, its adaptability with an uneven portion of the floor surface is good. Thus, it is possible to cut relatively large recesses, and it is also possible to sufficiently cope with projections by means of the hole 30 formed into the shape of an hourglass. In addition, deformation or breakage of the cutter shaft 16 or the cutter 18 owing to upward thrust of the cutter shaft can be prevented. Because, as compared with the conventional cutter with a circular hole, the cutter 18 with the hourglass hole 30 has a large impact force, as described above, and the cutter can be made more compact. Hence, the overall cutting machine can be made more compact, and it is possible to provide an impact-type cutting machine which excels in economic efficiency and operational features.

It should be noted that this invention is not restricted to the first and second embodiments, and various other applications and modifications are possible.

For instance, in the second embodiment of this invention, although the external portions of the cutter 18 which constitute striking portions for striking the floor surface are formed in a rectangular shape, as shown in FIGS. 10 and 11, it is possible to form the external portions of the cutter 18 into the same configuration as that of the hole 30, i.e., the configuration of an hourglass, or other configuration.

Referring specifically to FIGS. 10 and 11, there are illustrated two variations of the cutter shown in FIG. 8, except that the FIGS. 10 and 11 variations adopt an external configuration which substantially corresponds to the external configurations shown in FIGS. 6 and 7, respectively. That is, the cutter 18 of FIG. 10 is an elongated rectangular plate except that the elongated side edges are of a shallow concave configuration, whereby the overall plate itself hence has a somewhat hourglass-shaped configuration similar to the elongated hole 30.

As to the embodiment of FIG. 11, it has a configuration corresponding to the embodiment of FIG. 8 except that the opposite ends of the blade are somewhat rounded and provided with a series of outwardly projecting teeth formed along the periphery thereof, which teeth in the illustrated embodiment in effect define a serrated surface which extends around the complete end of the plate and hence around each of the corners defining the blade corners.

Although a particular preferred embodiment of the invention has been described in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A cutter for an impact-type cutting machine having a cutter shaft which is eccentrically provided on a drive shaft with respect to a rotational axis of said drive shaft and is adapted to eccentrically rotate around said drive shaft in conjunction with the rotation of said drive shaft, and a cutter having a hole in which said cutter shaft is inserted with play therebetween, said hole being extended in the longitudinal direction of said cutter, wherein a central portion of said hole substantially coincides with the center of gravity of said cutter, and wherein said hole is formed into the shape of a hyperboloid of cotyledons, or an hour-glass shape.

2. A cutter according to claim 1, having exterior side edges which, in the longitudinal direction, are of a shallow concave configuration.

3. A cutter according to claim 1, having a series of outwardly projecting teeth formd thereon at least in the vicinity of the ends thereof.

4. An impact-type cutting machine having a wheeled frame, a drive shaft rotatably supported on said frame for rotation about its longitudinal axis, a motor mounted on the frame and drivingly connected to the drive shaft for effecting rotation thereof, a radially enlarged flange secured to the drive shaft for rotation therewith, a plurality of cutter-support shafts secured to said flange so that each cutter support shaft extends generally parallel with and is spaced radially from the drive shaft, said plurality of cutter support shafts being substantially uniformly angularly spaced around the drive shaft, and a cutter blade freely pivotally supported on each said cutter support shaft for rotational movement relative thereto in response to rotational centrifugal effect, each cutter blade comprising a plate-like member having a hole therethrough for accommodating said support shaft, said hole being oversized relative to said support shaft, comprising the improvement wherein the plate-like member defining the cutter blade has a generally elongated rectangular configuration, and said hole comprising a slot which is elongated in the elongated direction of the plate-like member and which is closed at opposite ends thereof, said slot containing the center of gravity of the plate-like member, said slot having a length along said elongated direction which is several times greater than the diameter of the cutter support shaft, and said slot, in the elongated direction thereof, having a generally hourglass-shaped configuration with the narrowest restriction of said hourglass-shaped configuration being disposed substantially at the center of gravity of the plate-like member.

5. A machine according to claim 4, wherein said plate-like member has exterior side edges which, in the elongated direction of the member, are of a shallow concave configuration.

6. A machine according to claim 4, wherein said plate-like member has a series of outwardly projecting teeth formed thereon at least in the vicinity of the ends of the plate-like member.

* * * * *